US005252158A

United States Patent [19]

Shimizu et al.

[11] Patent Number: 5,252,158

[45] Date of Patent: Oct. 12, 1993

[54] METHOD AND APPARATUS FOR PRODUCING NONWOVEN FABRICS

[75] Inventors: Hisao Shimizu, Otsu; Miyoshi Okamoto, Takatsuki; Nobuo Kurata, Kouka, all of Japan

[73] Assignee: Toray Industries, Inc., Japan

[21] Appl. No.: 640,412

[22] PCT Filed: May 10, 1989

[86] PCT No.: PCT/JP89/00480

§ 371 Date: Jan. 23, 1992

§ 102(e) Date: Jan. 23, 1992

[87] PCT Pub. No.: WO90/13696

PCT Pub. Date: Nov. 15, 1990

[51] Int. Cl.[5] ..... D04H 3/16

[52] U.S. Cl. ..... 156/167; 156/181; 156/296; 156/441; 425/66; 19/299

[58] Field of Search ..... 156/167, 181, 441, 296; 19/299; 425/66

[56] References Cited

U.S. PATENT DOCUMENTS

| | | | |
|---|---|---|---|
| 3,250,602 | 5/1966 | Stalego | 156/167 X |
| 3,423,266 | 1/1969 | Davies et al. | 156/167 |
| 3,692,618 | 9/1972 | Dorschner et al. | 156/167 X |
| 3,763,521 | 10/1973 | Ricketts . | |
| 3,781,393 | 12/1973 | Feltgen et al. | 156/167 X |
| 3,796,619 | 3/1974 | Rich | 156/167 |
| 3,938,221 | 2/1976 | Ricketts . | |
| 4,217,387 | 8/1980 | Viezee et al. | 156/167 X |

FOREIGN PATENT DOCUMENTS

| | | |
|---|---|---|
| 47-43151 | 10/1972 | Japan . |
| 48-20970 | 3/1973 | Japan . |
| 48-27227 | 8/1973 | Japan . |
| 49-9436 | 3/1974 | Japan . |
| 49-29900 | 8/1974 | Japan . |
| 62-17057 | 1/1987 | Japan . |
| 62-184168 | 8/1987 | Japan . |
| 62-184169 | 8/1987 | Japan . |
| 62-184171 | 8/1987 | Japan . |
| 1088931 | 10/1967 | United Kingdom . |

*Primary Examiner*—Jeff H. Aftergut
*Attorney, Agent, or Firm*—Austin R. Miller

[57] ABSTRACT

The present invention relates to a novel method and apparatus for producing nonwoven fabrics. Generally, in production of nonwoven fabrics, in order to obtain a nonwoven fabric with a wide width, it has been impossible to obtain a uniform nonwoven fabric unless a large number of spinnerets ejecting fibers are installed in the width direction of the nonwoven fabric. The present invention relates to a novel method and apparatus for producing nonwoven fabrics capable of easily increasing the width of the fabric even when only few spinnerets are used. The method for producing nonwoven fabrics according to the present invention is characterized in that a group of fibers entrained with a high-speed fluid is ejected from a nozzle rotating around the axis of a substantially stationary cylindrical support as its rotational axis on the inner peripheral surface of the cylindrical support and is laminated thereon in the form of a web and furthermore, the web is resiliently pressed under a heating condition via a roller revolving on the inner peripheral surface of the cylindrical support around the revolutional axis which is the same as the rotational axis of the rotating nozzle and then, the web is taken up from the cylindrical support while it is slipped. In addition, the apparatus according to the present invention relates to an apparatus practicing the method.

37 Claims, 3 Drawing Sheets

METHOD AND APPARATUS FOR PRODUCING NONWOVEN FABRICS

TECHNICAL FIELD OF THE INVENTION

The present invention relates to a method and an apparatus for producing nonwoven fabrics. Generally, in a case of obtaining a wide nonwoven fabric in the production of nonwoven fabrics, it has been difficult to form the nonwoven fabric uniform, unless a large number of spinnerets ejecting fibers are installed in parallel in the width direction of the nonwoven fabric. The present invention relates to a novel method and apparatus for producing nonwoven fabrics having such features that enlargement of the width can be easily performed even when only a small number of spinnerets are employed.

BACKGROUND ART OF THE INVENTION

Recently, the market for nonwoven fabrics has been rapidly increased. Above all, needs for nonwoven fabrics made of long fibers have been rapidly increased as they have both tough strength and soft touch.

On the other hand, in the field of such nonwoven fabrics, nonwoven fabrics which have higher characteristics and higher functional properties have been required, and in addition, uses and required grades are also increased. Therefore, it has been required to develop such production processes that are in cope with a production of a lot of grades, particularly, industrially, economically and fully in cope with a small scale production with a lot of grades.

Namely, in the conventional general methods for industrially producing nonwoven fabrics made of long fibers, spun bundles of synthetic filaments are taken up by a high-speed fluid and they are ejected from many spinnerets arranged in the width direction and are collected as a web on a flat net to obtain a nonwoven fabric. This is a typical method and this method has been broadly practiced in use.

However, this method is suitable for a large scale production and the cost for facilities is high. Moreover, when the production is performed by changing conditions such as weight and width, loss accompanied with the change in conditions is large. Therefore, when only a small scale production is performed, there is an inconvenience that the cost becomes higher on the contrary. Furthermore, in the method where a large number Of spinnerets are arranged, there exist limits on uniformity of webs and isotropy of the properties of the webs.

Particularly, it is generally said in producing nonwoven fabrics that difficulty in achievement of uniformity increases in proportion to the square of width (namely, when the width is doubled, the technical difficulty is squared and increases to four-fold and when the width is tripled, the technical difficulty is squared and increases to nine-fold) and a high technology is necessary in actual production for obtaining a uniform and good web with a wide width.

To aim at realization of such a high technology, for example, as a method for improving uniformity of a web, methods for improving the arrangement of spinnerets were proposed in Japanese Patent Laid-Open SHO 62-17057, 62-184168, 62-184169 and 62-184171, but a new problem that the apparatus became more complicated was brought about and it was a real condition that the problem could not be solved by any possibility.

Therefore, realization of a technology suitable for producing a number of grades at small scale, i.e., realization of a technology which makes it possible to produce a nonwoven fabric with a uniform quality efficiently and with less loss by a simpler facility, especially realization of a technology which can sufficiently cope with the need for producing a nonwoven fabric with a wide width and makes it possible to produce a nonwoven fabric with a required high quality, is strongly required recently.

As one of the processes for producing nonwoven fabrics which basically have a possibility to satisfy such requirements, Japanese Patent Publication SHO 47-43151, Japanese Patent Laid-Open SHO 48-20970, FIG. 4 of Japanese Patent Publication SHO 49-9436 and Japanese Patent Publication SHO 48-27227 propose manufacturing processes for nonwoven fabrics wherein fibers are ejected on the inner peripheral surface of a polygonal prismlike cylinder constituted by a number of moving endless belts or the inner peripheral surface of a columnar cylinder, the fibers are collected in the form of a web on the inner peripheral surface and a cylindrical nonwoven fabric was taken up from the cylinder.

However, as far as the inventors of the present invention know, it has not been actually reported up to now that nonwoven fabrics have been industrially produced by such processes which are said to be classical technologies for producing nonwoven fabrics.

Considering the reason, it is thought that in the process where the inner peripheral surface of a polygonal prismlike cylinder constituted by a number of moving endless belts is utilized, as fibers are collected on the inner peripheral surface of the polygonal prismlike cylinder, a difference is generated between collecting and piling conditions of the fiber on the peaks (the corners) and the sides in the polygonal cross section, and there exists a fatal defect that it is difficult to make a uniform nonwoven fabric, and further, constituting a polygonal prismlike cylinder with a plurality of endless belts with a good accuracy itself and transferring and taking-up a cylindrical web by using a plurality of the endless belts itself are unexpectedly and technically difficult. In the process where the inner peripheral surface of a columnar cylinder is utilized, it is thought as the reason that it is actually technically difficult to continuously take off the web collected on the inner peripheral surface without spoiling uniformity of the web and with keeping the uniformity as it is.

DISCLOSURE OF THE INVENTION

Considering the above-described points, an object of the present invention is to provide a novel method and apparatus for producing nonwoven fabrics wherein a nonwoven fabric with a wide width can be easily produced without using a large number of spinnerets of a spinning machine, and in addition, a nonwoven fabric with excellent uniformities of weight and tenacity can be easily produced, and which, in the production of the nonwoven fabrics, basically does not have such an inconvenience as so-called "selvage loss" that both edges (both selvages) in the width direction of a nonwoven fabric should be cut away because they are nonuniform and is very suitable for use in small scale production of a lot of grades because change in weight can be easily performed. Basically, the object of the present invention is to provide a method and an apparatus for producing nonwoven fabrics wherein, by utilizing an old and well-known manufacturing process for nonwoven fabrics in which fibers are collected in the form of a web by utilizing the inner peripheral surface of a cylinder, to more industrially and skillfully produce nonwoven fabrics can be made actually possible.

The present invention has the following constitution.

Namely, the method for producing nonwoven fabrics according to the present invention is characterized in that a group of fibers entrained with a high-speed fluid is ejected from a nozzle rotating around the axis of a substantially stationary cylindrical support as its rotational axis onto the inner peripheral surface of the cylindrical support and is laminated thereon in the form of a web, and further, the web which is under a heating condition is resiliently pressed via a roller revolving on the inner peripheral surface of the cylindrical supporting around a revolutional axis which is the same as the rotational axis of the rotating nozzle, and then, the web is taken up from the cylindrical support while it is slipped.

An apparatus for producing nonwoven fabrics according to the present invention is characterized in that the apparatus comprises the following means (a)-(d):

(a) a substantially stationary cylindrical support for collecting and laminating fibers as a web on its inner peripheral surface, (b) means for ejecting a group of fibers entrained with a high-speed fluid onto the inner peripheral surface of the cylindrical support, (c) means for resiliently pressing the collected and laminated web under a heating condition on the inner peripheral surface of the cylindrical support, and (d) means for taking up the web substantially continuously from the cylindrical support.

In the method and the apparatus for producing nonwoven fabrics according to the present invention, since a nonwoven fabrics with a wide width can be easily manufactured even when a few spinnerets are used, it is in cope with and advantageous for a production of a number of grades by changing in grades and conditions (changing in weight and polymer) with little loss.

In addition, the nonwoven fabric obtained in the present invention has a continuous and cylindrical formation when it is taken up from the cylindrical support as it is and it can be used for pipes and bags by utilizing well the cylindrical structure as it is, or of course, it is possible to use the nonwoven fabric by cutting it into one sheet with an arbitrary width or into a plurality of small pieces of the nonwoven fabric. Further, by cutting it spirally with an arbitrary width, a continuous nonwoven fabric sheet can be obtained.

Furthermore, if the cylindrical nonwoven fabric is taken up on a take-up roll under a flat and folded condition when it is produced and the cut out product of the flat and folded one is made as the final product, the width of the take-up roll is only about one half of the width of the product. As a result, a space saving effect can be obtained thereby in the manufacturing process, the storage process and the transportation and distribution process.

Practical advantages according to the method and apparatus for producing nonwoven fabrics of the present invention will be listed in the following (1)-(10).

(1) As a web is formed by continuously laminating a number of thin webs made of collected groups of fibers ejected from a few number Of spinnerets, a web with substantially little nonuniformity is resulted and a nonwoven fabric without nonuniformity and being uniform can be obtained.

(2) Moreover, if very thin webs are laminated while they are sucked from the outer peripheral side of the cylindrical support, a nonwoven web and a nonwoven fabric with further less nonuniformity can be stably obtained.

(3) Basically, there exists no selvage loss.

(4) It is possible to obtain a nonwoven web or fabric with a sufficiently wide width by using only one spinneret.

For example, if a cylindrical support with an inner diameter of 1 m is used, it is possible to form a nonwoven fabric with a width of about 3.14 m which is the same length as the circumferential length.

Therefore, the manufacturing apparatus is compact and the space saving effect is extremely large.

(5) Since necessary production can be performed even when only one spinneret is used, loss in switching grades (such as changes in weight and raw materials) is low and the apparatus is suitable for the production of a small lot with a high efficiency.

(6) As described above, for example, the width of the takeup roll can be only about one half of the width of the final product, and thereby space saving on each process can be accomplished.

(7) It is also possible to easily perform to combine different polymers and to use these composite polymers, by utilizing the feature that the apparatus is suitable for the production of a small lot with high efficiency. Therefore, it is possible to produce a unique nonwoven fabric of composite raw material having various functionality and added value relatively freely and with a good efficiency.

(8) Since a cylindrical nonwoven fabric is obtained as a product with a basical structure, it can be made into and used as pipe-structure or bag-structure nonwoven fabric as it is. For example, if the high strength and high functionality of the nonwoven fabric are utilized as a substrate for bags for large goods and various small goods, the nonwoven fabric is very useful.

Furthermore, it is also utilized as a sheet or a plurality of sheets with an arbitrary width by cutting it in the form of a sheet.

In addition, a continuous nonwoven fabric sheet can be also obtained by cutting it out spirally with an arbitrary width.

Thus, the nonwoven fabric according to the present invention has such an advantage that it is freely made into the most suitable formation in cope with each application.

(9) Nonwoven fabrics obtained by the present invention can be broadly used in various uses such as a substrate for various container bags as described above, a substrate for pipes, a substrate for filters, a substrate for artificial leathers, a substrate for cleaners and wipers and a raw material for clothings.

(10) Comparing with the conventional method suitable for a large scale production, the method for producing nonwoven fabrics according to the present invention can correspond with and is suitable for small scale productions for various products such as a product using a special composite raw material, a product made by a detailed product design or special products, with small sharp turns.

Therefore, even in unknown uses and fields where nonwoven fabrics could not be used so far except the uses described in the above (9), the nonwoven fabric according to the present invention can provide special functionalities and added values and can have a technical possibility for a new development expected by the essential features of nonwoven fabrics.

BRIEF EXPLANATION OF THE DRAWINGS

FIG. 1 is a side sectional view of an apparatus for producing nonwoven fabrics according to an embodiment of the present invention.

FIG. 2 is a cross-sectional view of the apparatus, taken along A—A line of FIG. 1.

FIG. 3 is a schematic perspective view of take-up nip rolls and its vicinity shown in FIG. 1.

THE BEST MODE FOR CARRYING OUT THE INVENTION

Figure 1:
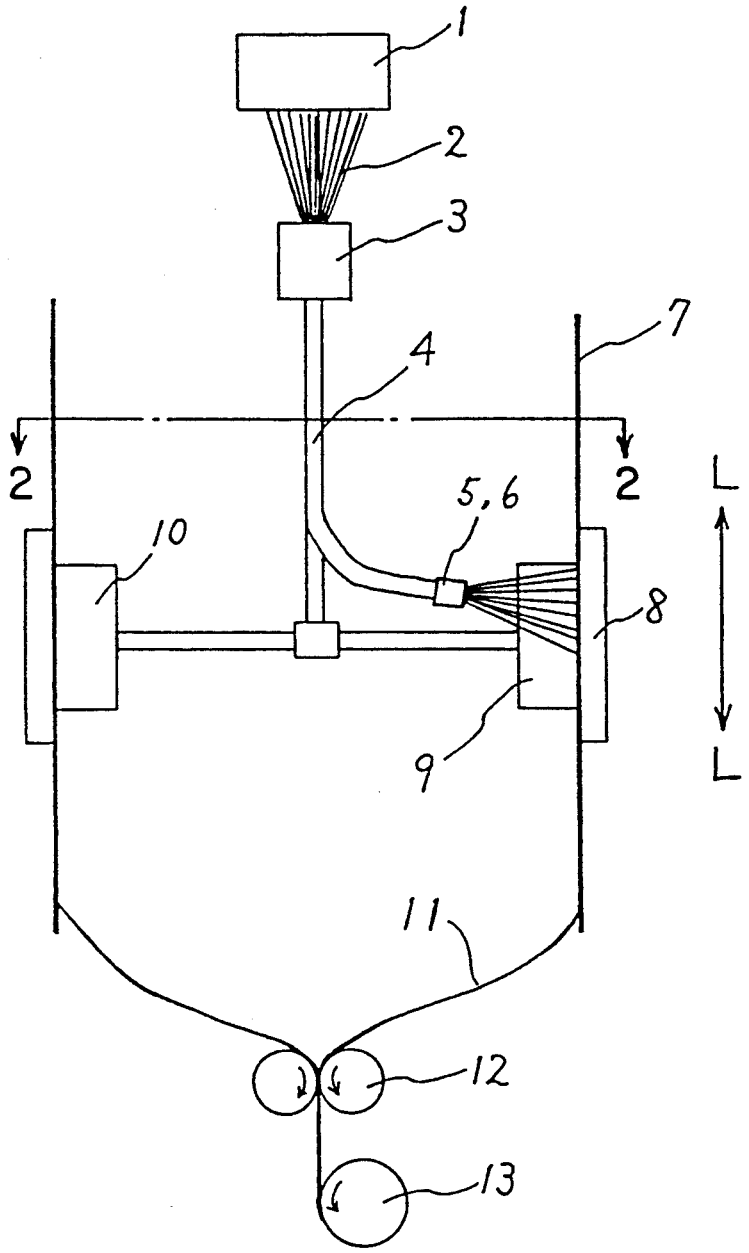
FIG. 1 to FIG. 3 are schematic views of an apparatus for producing nonwoven fabrics according to the present invention, illustrating an embodiment applied for practicing a method for producing nonwoven fabrics according to the present invention.

The present invention will be explained in more detail hereinbelow.

Up to this time, since nonwoven fabrics made of long fibers have been produced by arranging a large number of spinnerets in the width direction of the nonwoven fabrics, ejecting fibers therefrom, collecting them and widening the collected fibers into a sheet, ridge-like nonuniformity caused by interference between spinnerets has not been able to be avoided.

Against this problem, the inventors of the present invention have investigated if a nonwoven fabric with a wide width could be efficiently produced by using at least on spinneret, and in the aforementioned manufacturing process for nonwoven fabrics known for a long time wherein fibers are ejected onto the inner peripheral surface of a cylindrical support, they have obtained the result that the aimed purpose could be achieved by using especially a cylindrical support and conducting a specially-designed treatment in the cylindrical support.

The inventors of the present invention obtained the result that the aimed purpose could be achieved by the method wherein a substantially stationary cylindrical support was used and when a web was laminated on the inner peripheral surface of the support, a group of fibers entrained with a high-speed fluid was ejected from a nozzle rotating with a high speed of generally 5–100 rpm, preferably 10–50 rpm depending on the diameter of the support around the axis of the cylindrical support as its rotational axis and is laminated in the form of a very thin web, and furthermore, the group of fibers was collected and laminated on the inner peripheral surface of the support by resiliently pressing the very thin web under a heating condition via a roller revolving on the inner peripheral surface of the cylindrical support around a revolutional axis which is the same as the rotational axis of the rotating nozzle, and then, the web is taken up from the cylindrical support while it is slipped.

In practicing the present invention, since it is practical from the view point of apparatus that the rotational axis of the nozzle and the revolutional axis of the roller are made common to each other, it is practically preferable that the number of the rotation of the nozzle is equal to the number of the revolution of the roller. Particularly, it is very important that while the web collected as a layer is still under a very thin web condition, a press roller is immediately revolved once in cope With a rotation of the nozzle to apply continuously resilient pressing and especially, the resilient pressing is continuously applied while the very thin web is under a heating condition.

As described above, it is preferable that the number of the rotation of the nozzle is the same as the number of the revolution of the roller, and when a very thin web is formed, the number of the rotation and the revolution is desirably a high speed in the range or 5–100 rpm, preferably, 10–50 rpm. In addition, it is preferable in order to obtain a laminated web that a very thin web of a single layer unit ejected and formed by one rotation of the nozzle is made into a thin layer with a weight of 1–20 g/m$^2$, preferably 2–10 g/m$^2$.

The resilient pressing condition should be changed in accordance with the grade and the condition of a required nonwoven fabric, but it is preferable that the set pressure of an air cylinder, hydraulic cylinder etc., is in the range of 0.5–20 kg/cm$^2$.

In the present invention, the resilient pressing does not mean that a clearance between the roller and the inner peripheral surface is set at a specified fixed value when pressing is performed, but it means a pressing condition defined in such a manner that a proper pressing pressure in accordance with the change in the web thickness is continuously provided. For example, typically it means a pressing by an air cylinder, a hydraulic cylinder or an elastic material such as a spring. The pressing may be applied relatively and resiliently, and the means for providing the resilient pressing characteristic may be set on the roller side or the support side, or on both sides.

In addition, if a support whose inner peripheral surface is constructed from a porous material is used as the cylindrical support and a group of fibers is laminated on the inner peripheral surface of the support while the group of fibers is sucked form the outer peripheral side of the support through the porous material, the laminated step between webs is not conspicuous, a remarkable effect for making weight distribution uniform is expected and setting of quality such as weight and thickness becomes easier. Therefore, such a structure is preferable.

The present invention will be explained in more detail referring to the drawings.

Figure 2:
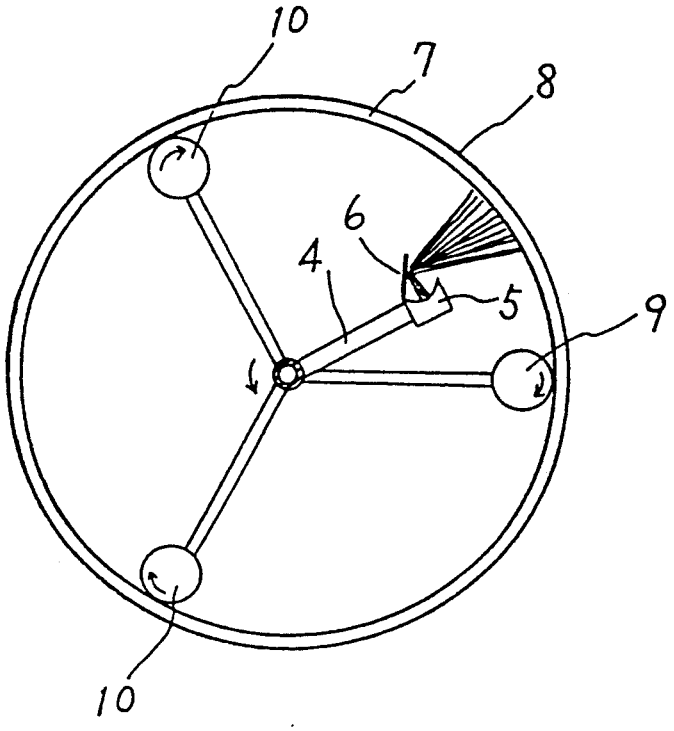
Figure 3:
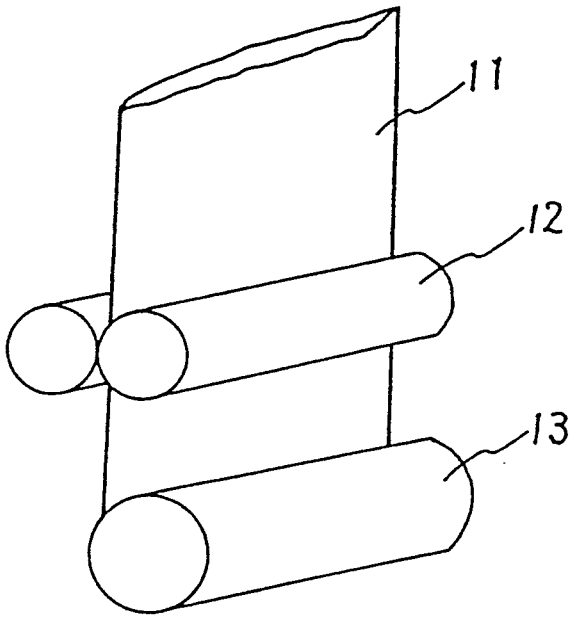

FIG. 1 to FIG. 3 are schematic explanatory views illustrating a preferable embodiment of a method and an apparatus for producing nonwoven fabrics according to the present invention.

In FIG. 1, fibrous material 2 spun from a spinneret 1 is sucked by an air ejector 3, passed through a fiber guide pipe 4, opened by two collisional reflecting plates 5 and 6 and ejected onto the inner peripheral surface of a cylindrical support 7 which constructed from an air-permeable material and from the outer peripheral side of which air is sucked. A suction device 8 is provided on the part to be ejected of cylindrical support 7 and the fibrous material 2 is sucked and collected as a web-like material.

FIG. 2 is a plan view of cylindrical support 7, and fiber guide pipe 4 ejects fibers toward the inner peripheral surface of the support while it is rotating around the axis of the cylindrical support as its rotational axis to form a band of the web-like material on the inner peripheral surface of the cylindrical support. The band of the web-like material is heat pressed immediately by a heating roller 9 revolving around the same axis and is further pressed by press rollers 10.

In the present invention, particularly the web is resiliently pressed by such rollers 9 and 10. The resilient pressing can be performed by various manners such that, for example, a cylinder actuated by air pressure or oil pressure or a spring is assembled into the supporting shaft of rollers 9 and 10 or the material of the surface members of the rollers are constructed from a porous material with an elastic property. It is of course possible to use together a plurality of such means as air pressure means (1), oil pressure means (2), a spring means (3) and an elastic material (4).

Alternatively, it is also possible that the member of the inner peripheral surface of the cylindrical support which collects fibers is especially constructed of another member different from the main body of the cylindrical support, the inner peripheral surface member is constituted in such a way that it is supported resiliently on the main body of the cylindrical support via at least one means among resilient characteristic providing means such as the air pressure means (1), Oil pressure means (2), spring means (3) and elastic material (4) and a web is resiliently pressed by a roller revolving and moving along the inner peripheral surface of the cylindrical support.

Such a resilient pressing is preferably performed under a heating condition at a temperature of not less than the melting point of the fibers.

The web thus heated and pressed and which has been reinforced in fiber bonding is successively taken up by take-up nip rolls 12 as a cylindrical web 11 and wound by a wind-up roll 13, as schematically shown in FIG. 3.

Although the cylindrical nonwoven fabric is nipped and wound up in the form of a sheet in the above embodiment, other embodiments may be done in such ways that the cylindrical nonwoven fabric is wound up while it is cut into two pieces or three or more pieces with an arbitrary width or it is wound up as a continuous nonwoven sheet while it is cut out spirally with an arbitrary width.

Moreover, although, in the embodiment illustrated in FIGS. 1 and 2, one heating roller and two pressing rollers are provided at the same position in the length direction L of support 7 and they press the web-like material on the inner peripheral surface of the support while they are revolved and moved around the same axis as the rotational axis of fiber guide pipe 4, such a structure is not always necessary. The pressing roller may be located at a position lower than the position of the heating roller in the lengthwise direction of the support (the direction L in FIG. 1) or another structure where the roller is revolved by another drive shaft can be employed.

It is preferable that the heating roller and the pressing rollers can rotate around their own axes accompanying with their revolution and motion on the inner peripheral surface.

The first point of the present invention is that a very thin web can be continuously laminated by only one spinneret. Moreover, if this web is made as thin as possible and the fibers are ejected and piled in such a distribution that the cross-sectional shape of the laminated web in the lengthwise direction of the support is formed as a mountain-like shape wherein its central portion is flat and its side portions extends gradually thinner as they approach both selvage portions, a uniform web having an extremely smooth lamination structure can be obtained, as compared with the case where selvage portions are formed as a rectangular shape and the selvage portions are stepwisely laminated.

To eject and pile fibers with such a distribution forming a mountain-like cross section, preferably a group of fibers is ejected while being oscillated in the lengthwise direction of the cylindrical support. In addition, it is preferable that, when a group of fibers is ejected, the group of fibers is electrically charged to obtain a good opening condition. Furthermore, it is also preferable that the group of fibers is ejected while it is opened by collision thereof to a collisional reflecting plate. These methods or means may be used together.

Means for ejecting a group of fibers preferably comprises a suction device for a fibrous material, a fiber guiding pipe and at least one collisional reflecting plate. The collisional reflecting means is preferably constructed from two collisional reflecting plates from the view point of that a good opening condition can be obtained and various combinations of ejection angles can be set thereby. The collisional reflecting plate is provided on the tip portion of means for ejecting fibers and the fiber ejecting angle can be controlled by adjusting the setting angle of the collisional reflecting plate.

The second point of the present invention is that a web is continuously laminated while the web is laminated on the inner peripheral surface of the support as well as the web is resiliantly pressed by a press roller and a heating roller, and the web whose fiber bonding strength is increased by the pressing is substantially continuously taken up from the cylindrical support while it is slipped.

When a cylindrical support whose inner peripheral surface is constructed of a porous material is used and a group of fibers is laminated while the group of fibers is sucked from the outer peripheral side of the support through the porous material, it is effective to improve the quality of the nonwoven fabric and to perform a smooth take-up thereof from the cylindrical support while it is slipped, because the lamination can be made with little disorder and good uniformity and the reinforcement of fiber bonding by the pressing can be very effectively done. This sucking prevents the initially formed web from being disturbed and blown away by a strong air jet generated by a fiber ejection device as well as enables to make a web without disorder and uniformly laminated because the ejected gas is sucked and exhausted. Further, a heating roller and a pressing roller immediately and resiliently press the web under a heating condition to substantially bind the fibers and to make it possible to make the web furthermore flat and to collect uniformly a web successively formed thereon and furthermore, the rollers press the successively collected web in the same manner under a heating condition to make the webs in an integral and flat material. By repeating such laminations and pressings, a cylindrical nonwoven fabric whose fibers are uniformly and strongly bound can be well formed.

The heating roller and the pressing roller also have a function for supporting the laminated web so as to prevent it from falling down in the manufacturing process. These rollers are preferably attached around the same axis as the axis for a fiber guiding pipe and are revolved and moved while they press the web. Therefore, the web is always and partly pressed by the rollers. However, since the pressed position is continuously moved and the web has an appropriate elongation, the web can be taken up downward and substantially continuously.

The heating roller and the pressing roller are preferably at the same position, but they may be at positions different from each other. Moreover, the heating roller and the pressing roller are not necessarily different kinds of ones, but one roller or a plurality of rollers having both functions can be used.

In addition, in the method according to the present invention, it is not always necessary to press the web under a heating condition on every lamination of a web on the inner peripheral surface of the support, but the heating and pressing may be performed after the lamination proceeds to some extent.

As shown in FIG. 1, in the case where holes are opened on the cylindrical support such that a high-speed fluid can be passed through them and a suction part is provided on the portion to be ejected such that fibers can be stably collected, the width of the suction part is preferably set to be larger than the width of ejection of the web. This suction part can be provided at an arbitrary position except the fiber ejection part to support the web.

Although the material for the cylindrical support is not particularly restricted, mesh- and net-shaped materials, for example, a punching metal, is preferably used as a gas permeable material. In this case, the opening ratio is generally 20–60%. The hole size is to be not so large such that the ejected fibers cannot pass through the holes, and an arbitrary shape such as a circle, a slit and a grid can be employed as the shape of the holes. When a suction part as shown by numeral 8 in FIG. 1 is provided, the suction capacity of a pump is appropriately decided by taking totally the amount of air ejected from an ejector, stable collection of a web and a suction force for supporting the web not to fall down, into account.

As the heating source for the heating roll, any generally available heating method such as electrical heating and dielectrical heating can be used. In addition, such a roller that blows hot air from the surface of the roller can be used as the heating roller.

For practicing the method according to the present invention, it is not necessary to use a heated roller, and only as long as a web can be pressed under a heating condition, the roller itself is not necessarily heated. In addition, as means for heating the web, heating means such as heating by hot air, infrared heating or heating by a laser etc., can be used, and appropriate combination of these means or combination thereof with the above-mentioned electrically heating roller or dielectrically heating roller can be also used. Furthermore, a heating zone may be provided at any position of the cylindrical support (for example, a position below the suction part shown by numeral 8 in FIG. 1).

Number and arrangement of the heating roller and the pressing roller can be appropriately determined by taking wholly kind of the fiber raw material, weight of the nonwoven fabrics and processing speed into account. Although the heating roller and the pressing roller may be the common one as described above, according to the results obtained by the inventors of the present invention, pressing the web is preferably performed by using at least two rollers including at least one roller pressing the web under a heating condition, and especially the embodiment using one heating roller and two pressing rollers as shown in FIG. 2 is one of the preferable embodiments. Moreover, according to the knowledges of the inventors of the present invention, an embodiment wherein a plurality of rollers, for example, two or three rollers are used and all of these rollers are used as rollers served for both of heating and pressing is the most preferable embodiment because detailed temperature setting is easily possible.

The shape and dimension of the heating roller and the pressing roller are not specifically restricted, but it is preferable that the cross section is substantially a circle and the width is larger than the width for ejecting and collecting the web.

The surface is not necessarily flat, but an uneven surface such as embossing pattern etc., one having a satin surface or a channelled roll having a forwarding operation to move a web downward may be used.

It is preferable that the surfaces of these rollers are coated with a silicone resin or a fluorine resin from the view points of heat resistance and durability of the rollers and smooth revolution and movement thereof on the web.

Although conditions for pressing the web under a heating condition may be appropriately determined by taking kind of a fiber to be used, weight of the web, processing speed etc., into consideration, it is generally preferable that resilient pressing is performed under a heating condition at a temperature not less than the melting point of the fiber.

When such heating and pressing are performed, means except the heating roller can be of course applied, and those means wherein pressing is performed by an unheated pressing roller while warm air or hot air is blown on the web or wherein roller pressing is performed while the fibrous material is still at a high temperature before it is cooled down, may be used.

As the fibrous raw materials used in the present invention, various fibers such as ordinary fibers, islands-in-a-sea type fibers, peeled and divided type composite fibers and special polymer blend type fibers can be used. For example, fiber-forming polymers such as homopolymers and copolymers of polyester, polyamide, polyacrylic, polyolefin, polyvinyl chloride, polyurethane can be used, and in addition, heatfusible fibers can be freely used together. Furthermore, regenerated fibers such as rayons can be applied.

Moreover, a fiber consisting of one component or multicomponents can be used. Especially, using those ultrathinnable fibers dividable into very fine fibers such as islands-in-a-sea type fibers and peeled and divided type composite fibers are preferable because these fibers can be easily made into ultrafine fibers by chemical treatment, physical treatment or a combination thereof after nonwoven fabrics are prepared and nonwoven fabrics made of ultrafine fibers such as artificial leather like ones can be thereby obtained. When such ultrathinnable fibers are used, it is preferable that those fibers which are ultrathinnable into 0.5 denier or thinner, preferably 0.2 denier or thinner as their monofilament denier are used as soft touch can be obtained.

In the present invention, it is preferable that a group of fibers forming a nonwoven fabric contains a low melting point component. For example, it is preferable that the fiber is a composite fiber consisting of at least two components having different melting points or a group of fibers is a group of mixed fibers containing two or more kinds of fibers having different melting points. Under these combinations, when pressing is performed under a heating condition substantially at the melting point or higher of the low melting point side and below the melting point of the high melting point fiber, a nonwoven fabric with good dimensional stability and uniformity can be produced without spoiling softness.

In the present invention, it is preferable that the fibers used have low shrink characteristics, and if they have a high shrinkage ratio, while they are collected and pressed under a heating condition, they greatly shrinks under a cylindrical condition, and not only a nonwoven fabrics with a good quality cannot be obtained but also stable production is hard. On these points, according to knowledges of the inventors of the present invention, it is preferable that the fibers used in the present invention should have a shrink characteristic of 10% or smaller in terms of a dry heat shrinkage ratio at 150° C. Moreover, from the view point of satisfying such a shrink characteristic, it is preferable that composite fibers contain a polyamide fiber component and a group of mixed fibers contains a polyamide fiber.

Moreover, if the fibers used in the present invention are straight fibers, it must be taken into consideration that when the fibers are collected and pressed under a heating condition, they straightly shrink and as the result, the nonwoven fabric greatly shrinks under a cylindrical condition.

From this point of view, it is preferable that the fibers with crimps are used as the fibers used in the present invention. When the fibers with crimps are used, even if the fibers shrink under a cylindrical condition, there exist a "room" until the fibers become straight and then are cramped and therefore, they are not largely shrunk as they are under a cylindrical condition and more stable production is possible. To use such fibers with crimps, it is effective that the fibers used in the present invention are especially constituted as an eccentric core-sheath type composite fiber or a bimetal type composite fiber.

As the high-speed fluid for taking up fibers in the present invention, air, steam, water and combinations thereof can be used and gas the main component of which is air or steam is preferable. Air can be easily handled and the take-up speed can be made higher by using air. On the other hand, when steam is used, there is an advantageous point that heat treatment and drawing can be simultaneously performed while collecting the fibers. These fluids are ordinarily used at a room temperature, but, if necessary, they can be used at an elevated temperature.

As the method for taking up the fibers by a high-speed fluid, conventional and known technologies can be applied and are not specifically restricted.

In the case of ordinary melt spinning, the take-up speed of the fibers is not less than 2,000 m/min, preferably not less than 3,000 m/min, more preferably not less than 5,000 m/min and filamentary fibers thus spun and taken-up can be used as fibers to be supplied in the present invention. Alternatively, after melt-spun fibers are drawn at a drawing speed of 2,000 m/min or larger, preferably 3,000 m/min or larger by rollers, the filamentary fibers are transferred by a high-speed fluid and can be used as fibers to be supplied in the present invention.

The shape of fibers collected by such a fluid is not specifically limited, and not only filamentary fibers but those having a melt-blown shape or obtained by a flash spinning can be used.

The fibers can be ejected and laminated on the inner peripheral surface of the support with either a shape of long fibers or a shape of short fibers. Moreover, a method for producing nonwoven fabrics according to the present invention can be applied in various manufacturing processes of nonwoven fabrics such as so-called spun-bond method, melt-blow method, flash spinning method etc.

In addition, as the fiber guiding pipe 4 shown in FIGS. 1 and 2 in the present invention, those with a straight pipe-shape or made into a curved pipe-shape can be used and they are supported such that they are rotated at the center of a cylindrical support A collisional reflecting plate for opening fibers is provided at an ejection part of the fiber guiding pipe, and it is preferable that it is constituted so that the ejecting direction and extension of fibers can be arbitrarily controlled. By this constitution, ejection with an arbitrary width can be performed on the inner peripheral surface of the cylindrical support and precise adjustment of weight and formation of a uniform web can be also achieved.

In the case when the fiber guiding pipe is a straight pipe, fibers can be laminated on the entire inner peripheral surface by rotating the collisional reflecting plate, and as the shape and the length of the fibers, a properly designed ones are selectively used in accordance with the diameter of the cylindrical support, namely, the ejection distance. In the case of a curved pipe, a special consideration should be taken into account on the shape of the curved portion and the length after the curved portion to prevent the fibers from clogging and entangling in the fiber guiding pipe. According to the knowledge of the inventors of the present invention, when the fibers guiding pipe is a curved pipe, it is preferable that one which gradually curves is used and the curvature radius is preferably not less than 30 mm, more preferably not less than 50 mm.

The collisional reflecting plate set on the ejecting port for the fibers preferably can perform simultaneously both to control the angle and to shake its head (oscillation), because the width Of the web can be arbitrarily controlled and uniformity thereof is also improved. It is also preferable that the fibers are electrically charged to improve ejecting and opening characteristics of the fibers and earthed to remove static electricity generated by friction. It is preferable that the collisional reflecting plate is constituted by using an air passable member. By making so, as air can passes through it flying of the fibers in all directions caused by reflection of air flow can be prevented.

The distance between the ejection port for the fibers and the support, namely, the collecting distance can be appropriately determined according to the width and uniformity of the web and it is preferably 10–100 cm, more preferably 20–80 cm.

Weight of the web can be adequately controlled in accordance with the amount of ejection of the fibers, the rotational speed of the fiber guiding pipe and the take-up speed.

Width of the web can be changed by changing the diameter of the cylindrical support or cutting a web with a wide width into a specified width. Anyhow, as a selvage portion is not basically formed in the method according to the present invention, cut loss can be limited within the minimum.

Although the number of laminations of the web is not particularly restricted, a certain number of laminations are necessary from both points of uniformity of weight and productivity, and 3–60 layers are generally preferable and it is especially preferable that the number of laminations is within the range of 5–50 layers.

Moreover, to make taking-up of nonwoven fabrics smooth, auxiliary means such as one for making the inner surface of the cylindrical support easily slippery, vibrating the cylindrical support or blowing air from the Outside of the cylindrical support can be applied.

As the take-up roller for pulling out a web from the cylindrical support, it is sufficient to use ordinarily, for example, a roller made of rubber and if it is a heating roller, fusion treatment as well as taking up can be simultaneously performed.

In the present invention, by pulling out a web whose fiber bonding has been sufficiently and uniformly performed from the cylindrical support by a take-up roller, the nonwoven web can be well and continuously pulled out from the support while it is slipped.

The taken-up nonwoven web obtained by the above described method of the present invention can be used as a nonwoven fabric as it is, but it is preferable that improvement of physical properties and uniformity are attempted by performing furthermore a binding or entangling treatment on the nonwoven fabric. Namely, one or a plurality of processing treatments such as a high-speed fluid treatment, a needle punch treatment, a fusion treatment and an adhesion treatment can be applied thereon depending on the purpose.

In addition, such nonwoven fabrics may be drawn in the width direction or in the lengthwise direction to control the orientation of the fibers, to improve the physical properties and to improve the anisotropy.

Moreover, a heatset treatment, a dyeing treatment, an antistatic treatment etc., can be appropriately performed in an arbitrary process.

As described above, formation of a wide width can be achieved by a few number of spinnerets in the present invention. However, if necessary, the number of the spinnerets can be increased. In this case, a special attention on the arrangement of ejection ports for fibers should be necessary not to produce nonuniformity caused by the interference between spinnerets.

In addition, when the number of spinnerets is set two or more, there is an advantage that different polymers can be simultaneously laminated.

As is evident from the above described explanation, the method for producing nonwoven fabrics according to the present invention is suitable for using various special composite raw materials, detailed product designing or a small scale production of a special product in comparison with conventional methods.

Examples of the present invention will be explained hereinbelow, but the present invention is not restricted thereby.

EXAMPLE 1

Nylon 6 polymer was spun from a spinning nozzle at a spinning temperature of 275° C.), and using an apparatus in accordance with the apparatus shown in FIG. 1, the spun filaments were sucked by an air ejector at an air pressure of 4 kg/cm$^2$. The filaments were ejected toward the inner peripheral surface of the cylindrical support while the second collisional reflecting plate was oscillated and the fiber guiding pipe (a nozzle) was rotated at 20 rpm and the fibers were opened.

The cylindrical support had an inner diameter of 100 cm and two heating rollers and one pressing roller were provided inside. All the rollers could be resiliently pressed by air cylinders. The inner peripheral surface was constructed of a porous material and sucked from the outer peripheral surface side.

The fibers were collected by the above ejection in such a way that a mountain-like shaped web cross-sectional distribution wherein the central portion was thick and the thickness gradually became thinner toward both selvage portions was exhibited (the web of a single layer had a weight of about 10 g/m$^2$). Furthermore, the web was continuously laminated while the web was resiliently pressed by using two heating rollers at 200° C. (electrical heating) and a pressing roller at a room temperature both set at a cylinder air pressure of 5 kg/cm$^2$. A cylindrical nonwoven fabric consisting of fibers with an average fiber denier of 0.8 and with an average number of laminations of 6 layers, an average weight of about 60 g/m$^2$ and the entire width of about a little over 3 m could be taken up at a take-up speed of about 1 m/min.

The nonwoven fabric thus obtained exhibited uniform weight and high tenacity and had a good appearance with hardly noticeable trace of lamination. It was suitable for clothing raw materials such as clothes for surgical operations and dust-free clothes and substrates for industrial materials such as substrates for leathers and substrates for filters.

EXAMPLE 2

Islands-in-a-sea-type fibers consisting of nylon 6 as the island component and a hot water-soluble polymer made by copolymerizing polyethylene terephthalate with isophthalate and 5-sodium sulfoisophthalate as the sea component (where the island component was 80 wt. %; the sea component was 20 wt. %; the number of islands was 70) were spun from a spinning nozzle at a spinning temperature of 285° C. and taken up by a godet roller of 4,000 m/min. Furthermore, using an apparatus shown in FIG. 1 the fibers were sucked by an air ejector at an air pressure of 3 kg/cm$^2$ and were ejected toward the inner peripheral surface of the cylindrical support while the second collisional reflecting plate was oscillated, a fiber guiding pipe (a nozzle) was rotated at 20 rpm and the fibers were opened.

The cylindrical support had an inner diameter of 100 cm and one heating roller and two pressing rollers were provided therein. All the rollers were resiliently pressed by air cylinders and the inner peripheral surface was constructed of a porous material and was sucked from the outer peripheral side.

The fibers were collected by the above ejection in such a way that a mountain-like-shaped web cross-sectional distribution wherein the central portion was thick and the thickness gradually became thinner toward both selvage portions was exhibited (the web of a single layer had a weight of about 8 g/m$^2$). Furthermore, the web was continuously laminated while the web was resiliently pressed by using a heating roller at 150° C. (electrical heating) and two pressing rollers at a room temperature both set at a cylinder air pressure of 3.5 kg/cm$^2$. A cylindrical nonwoven fabric consisting of fibers with an average fiber denier of 3.2 and with an average number of laminations of 6 layers, an average weight of 48 g/m$^2$ and the entire width of about a little over 3 m was taken up at a takeup speed of about 1 m/min and was furthermore cut out spirally with a width of 1 m to obtain a continuous nonwoven fabric with a width of 1 m.

Then, the nonwoven fabric thus obtained was needle-punched with a needle density of 1,000 pcs/cm$^2$ and then, was treated by dissolving the sea component in a water bath at 95° C. to dissolve and remove the sea component. Furthermore, while a plate nozzle having a large number of holes with a diameter of 0.2 mm was vibrated, the surface and the rear face were treated each one time at a water pressure of 50 kg/cm$^2$ and furthermore, the surface and the rear face were treated each one time at a water pressure of 100 kg/cm$^2$.

This product was well entangled even though it was made of long fibers, and was soft and strong, had uniform weight and had hardly frayed selvage and was suitable for wiping clothes and filter use.

EXAMPLE 3

Composite fibers wherein nylon 6 polymer was the core component and polyethylene was the sheath component (the weight ratio of core/sheath=50/50) were spun from a spinning nozzle at a spinning temperature of 265° C. and taken up by a godet roller of 4,000 m/min. Furthermore, using an apparatus shown in FIG. 1, the fibers were sucked by an air ejector at an air pressure of 3 kg/cm$^2$ and were ejected toward the inner peripheral surface of the cylindrical support while the second collisional reflecting plate was oscillated, a fiber guiding pipe (a nozzle) was rotated at 20 rpm and the fibers were opened.

The cylindrical support had an inner diameter of 100 cm and one heating roller and two pressing rollers were provided inside. All the rollers were resiliently pressed by air cylinders and the inner peripheral surface was constructed of a porous material and was sucked from the outer peripheral side.

The fibers were collected by the above ejection in such a way that a mountain-like-shaped web cross-sectional distribution wherein the central portion was thick and the thickness gradually became thinner toward both selvage portions was exhibited (the web of a single layer had a weight of about 5 g/m$^2$) and furthermore, the web was continuously laminated while the web was resiliently pressed by using a heating roller at 130° C. (electrical heating) and two pressing rollers at a room temperature both set at a cylinder air pressure of 3 kg/cm$^2$. A cylindrical nonwoven fabric consisting of fibers with an average fiber denier of 1.2 and with an average number of lamination of 6 layers, an average weight of 30 g/m$^2$ and the entire width of about a little over 3 m could be taken up at a take-up speed of about 1 m/min.

The nonwoven fabric thus obtained exhibited uniform weight and good appearance with hardly noticeable trace of lamination. It was suitable for clothing raw materials such as clothes for surgical operations and dust-free and substrates for industrial materials such as heat-sealable base materials and bags.

EXAMPLE 4

A composite fiber nonwoven fabric was produced by using a copolymerized polybutylene terephthalate (wherein 30% of isophthalic acid were copolymerized) as the sheath component at a spinning temperature of 270° C. and a heating temperature of 140° C. in the above described Example 3, using the same conditions except above described conditions, and a uniform and good nonwoven fabric could be obtained. This nonwoven fabric exhibited a strong tenacity and had a heat-sealable characteristic, and was suitable for substrates for container bags.

COMPARATIVE EXAMPLE 1

Webs were laminated by the same conditions as those in Example 1 except no pressing by heating and pressing rollers.

Fibers were collected and laminated by the suction from the outer periphery of the cylindrical support, but when a take-up force was applied thereon, the web was partly broken and production of nonwoven fabrics could not be performed at all.

COMPARATIVE EXAMPLE 2

Webs were laminated by the same conditions as those in Example 1 except using heating rollers without heating.

In this embodiment, as almost the same as in the Comparative Example 1, when a take-up force was applied thereon, the web was partly broken and production of nonwoven fabrics could not be performed at all.

COMPARATIVE EXAMPLE 3

Webs were laminated by the same conditions as those in Example 1 except the following conditions. Namely, each clearance between each heating roller and pressing roller and the inner peripheral surface of the cylindrical support was set constant so as to become substantially zero while the smooth rotation of each roller was kept, and it was thereby impossible to press resiliently.

Under such manufacturing conditions, the web of the first layer could be smoothly formed, but as lamination proceeded, the web became thicker and an unreasonable force was applied on the rotation of the rollers. It was thereby impossible to press uniformly and to obtain a uniform nonwoven fabric.

In addition, it was recognized that even nonwoven fabrics obtained by performing lamination up to a laminated condition where not so much unreasonable force was applied on rotation of the rollers, partly had nonuniformity probably caused by unevenness of pressing force. It had portions with weak tenacity and portions with fluffs, and it was impossible eventually to obtain a nonwoven fabric with a good quality.

We claim:

1. A method for producing nonwoven fabrics characterized in that a group of fibers entrained with a high-speed fluid is ejected from a nozzle rotating around an axis of a substantially stationary cylindrical support as its rotational axis onto an inner peripheral surface of said cylindrical support and is laminated thereon as a web and furthermore, said web which is under a heating condition is resiliently pressed via a roller revolving on the inner peripheral surface of the cylindrical support around a revolutional axis which is the same as the rotational axis of said rotating nozzle and then, said web is taken up from said cylindrical support as a nonwoven fabric while it is slipped.

2. The method for producing nonwoven fabrics as described in claim 1 wherein the number of rotations of said ejecting nozzle is equal to the number of revolutions of said roller.

3. The method for producing nonwoven fabrics as described in claim 1 wherein the fibers entrained with said high-speed fluid are filamentary fibers entrained with said high-speed fluid after they are spun from a spinning nozzle at a speed of not less than 2,000 m/min. than 2,000 m/min.

4. The method for producing nonwoven fabrics as described in claim 1 wherein the fibers are composite fibers consisting of at least two components having different melting points.

5. The method for producing nonwoven fabrics as described in claim 4 wherein the fibers contain a polyamide fiber component.

6. The method for producing nonwoven fabrics as described in claim 1 wherein said group of fibers contains two or more kinds of fibers with melting points different from each other.

7. The method for producing nonwoven fabrics as described in claim 6 wherein said group of fibers contains polyamide fibers.

8. The method for producing nonwoven fabrics as described in claim 1 wherein the fibers are thinnable fibers dividable into ultrafine fibers and the monofilament denier of which after being divided into ultrafine fibers is not greater than 0.2 denier.

9. The method for producing nonwoven fabrics as described in claim 1 wherein the fibers have a shrink characteristic of not greater than 10% in terms of dry heat shrinkage ratio at 150° C.

10. The method for producing nonwoven fabrics as described in claim 1 wherein the fibers have crimps.

11. The method for producing nonwoven fabrics as described in claim 1 wherein, when said group of fibers is ejected and laminated, said group of fibers is ejected while it is oscillated in a longitudinal direction of the cylindrical support.

12. The method for producing nonwoven fabrics as described in claim 1 wherein, when said group of fibers is ejected, said group of fibers is electrically charged.

13. The method for producing nonwoven fabrics as described in claim 1 wherein, when said group of fibers is ejected, said group of fibers is opened by collision of said group of fibers onto a collisional reflecting plate.

14. The method for producing nonwoven fabrics as described in claim 1 wherein a cylindrical support whose inner peripheral surface is constructed of a porous material is used as said cylindrical support, and said group of fibers is laminated on the inner peripheral surface of the support while an operation for sucking the group of fibers is provided through said porous material from a outer peripheral side of the support.

15. The method for producing nonwoven fabrics as described in claim 1 wherein said group of fibers is ejected toward the inner peripheral surface of the cylindrical support by making the group of fibers entrained with a high-speed fluid collide and reflect on a collisional reflecting plate provided at a tip portion of said nozzle and constructed from an air passable material.

16. The method for producing nonwoven fabrics as described in claim 1, wherein said fibers have a melting point, wherein said resilient pressing is performed under a heating condition at a temperature not less than the melting point of the fibers.

17. The method for producing nonwoven fabrics as described in claim 1 wherein the resilient pressing by said roller revolving on the inner peripheral surface of the cylindrical support is performed via at least one means selected from the group consisting of air pressure means, oil pressure means, spring means, and elastic means providing resilient characteristics.

18. The method for producing nonwoven fabrics as described in claim 1 wherein said pressing of the web which is under a heating condition is performed by pressing by said roller while hot air is blown on said web.

19. The method for producing nonwoven fabrics as described in claim 1 wherein said roller is an emboss roller with an emboss pattern.

20. The method for producing nonwoven fabrics as described in claim 1 wherein said taken-up web is wound in a form of a flat sheet as it is in a cylindrical shape.

21. The method for producing nonwoven fabrics as described in claim 1 wherein said taken-up web is cut into two or more sheets of small pieces from a cylindrical state and then said two or more sheets are wound.

22. The method for producing nonwoven fabrics as described in claim 1 wherein said taken-up web is cut spirally with an arbitrary width and wound as a continuous long web.

23. The method for producing nonwoven fabrics as described in claim 1 wherein to said taken-up web, at least one treatment selected from the group consisting of needle punching treatment, punching treatment with a high-speed fluid and fusion treatment is additionally applied and the web is taken up.

24. An apparatus for producing nonwoven fabrics characterized in that said apparatus comprises:

(a) a substantially stationary cylindrical support collecting fibers as a web on its inner peripheral surface, (b) means for ejecting a group of fibers entrained with a high-speed fluid onto the inner peripheral surface of said cylindrical support, (c) means for performing a resilient pressing to a collected and laminated web under a heating condition on the inner peripheral surface of said cylindrical support, and (d) means for taking up said web in the form of a nonwoven fabric from said cylindrical support substantially continuously.

25. The apparatus for producing nonwoven fabrics as described in claim 24 wherein said means for performing a resilient pressing on the web is means for pressing by a roller revolving and moving around a rotational axis which is common to an axis of said cylindrical support.

26. The apparatus for producing nonwoven fabrics as described in claim 25 wherein said resilient pressing means comprises said roller and the resilient pressing by said roller is performed via at least one means selected from the group consisting of air pressure means, oil pressure means, spring means and elastic material means for providing resilient characteristics.

27. The apparatus for producing nonwoven fabrics as described in claim 25 wherein a member of the inner peripheral surface of the cylindrical support collecting the fibers is made of a member different from that of a main body of said cylindrical support, said member of the inner peripheral surface is resiliently supported on the main body of said cylindrical support via at least one means selected from the group consisting of air pressure means, oil pressure means, spring means and elastic material means for providing resilient characteristics and pressing is performed by said roller revolving and moving on the inner peripheral surface of said cylindrical support.

28. The apparatus for producing nonwoven fabrics as described in claim 24 wherein said cylindrical support is constructed from a porous material.

29. The apparatus for producing nonwoven fabrics as described in claim 28 wherein a suction device, which sucks the group of fibers collected on said inner peripheral surface of said cylindrical support constructed from said porous material from an outer peripheral side of said support, is provided.

30. The apparatus for producing nonwoven fabrics as described in claim 24 wherein said means for ejecting a group of fibers is a nozzle rotating around a rotational axis which is identical to an axis of said cylindrical support.

31. The apparatus for producing nonwoven fabrics as described in claim 24 wherein said means for ejecting a group of fibers comprises a suction device for fibrous substance, a fiber guiding pipe and at least one collisional reflecting plate.

32. The apparatus for producing nonwoven fabrics as described in claim 24 wherein a collisional reflecting plate, an, ejecting angle of which can be freely controlled, is provided at a tip portion of said means for ejecting a group of fibers.

33. The apparatus for producing nonwoven fabrics as described in claim 24 wherein said pressing means is a roller having a coated surface and the surface of said roller is coated with a silicone resin or a fluorine resin.

34. The apparatus for producing nonwoven fabrics as described in claim 24 wherein said pressing means is means of at least two rollers including at least one pressing roller pressing the web under a heating condition.

35. The apparatus for producing nonwoven fabrics as described in claim 24 wherein said pressing means is means of at least two rollers including at least one roller blowing hot air from its roller surface.

36. The apparatus for producing nonwoven fabrics as described in claim 24 wherein a heating zone is provided on the cylindrical support.

37. The apparatus for producing nonwoven fabrics as described in claim 24 wherein at least one heating means selected from the group consisting of hot air means, infrared ray means and laser beam means is used as heating means for webs.

* * * * *

UNITED STATES PATENT AND TRADEMARK OFFICE

CERTIFICATE OF CORRECTION

PATENT NO. : 5,252,158

DATED : October 12, 1993

INVENTOR(S) : Hisao Shimizu et al

It is certified that error appears in the above-indentified patent and that said Letters Patent is hereby corrected as shown below:

In Column 16, Line 61, delete "than 2,000 m/min."

In Column 19, Line 11, delete the comma.

Signed and Sealed this

Nineteenth Day of April, 1994

Bruce Lehman

*Attest:*

BRUCE LEHMAN

*Attesting Officer*

*Commissioner of Patents and Trademarks*